US006048152A

United States Patent [19]

Koyama

[11] Patent Number: 6,048,152

[45] Date of Patent: Apr. 11, 2000

[54] BINDING APPARATUS

[75] Inventor: Kenji Koyama, Kasugai, Japan

[73] Assignee: Kabushiki Kaisha Aichi Business Form, Aichi, Japan

[21] Appl. No.: 09/186,551

[22] Filed: Nov. 5, 1998

[30] Foreign Application Priority Data

Sep. 3, 1998 [JP] Japan ..... 10-248971

[51] Int. Cl.[7] ..... B42C 13/00

[52] U.S. Cl. ..... 412/22; 412/16

[58] Field of Search ..... 412/2, 4, 6, 8, 412/16, 19, 21, 22, 26, 28, 35, 37; 83/255, 404; 270/32, 45, 30.08, 30.01

[56] References Cited

U.S. PATENT DOCUMENTS

| | | | |
|---|---|---|---|
| 2,645,795 | 7/1953 | Pitner | 412/2 |
| 4,484,501 | 11/1984 | Ramcke | 412/2 X |
| 4,592,651 | 6/1986 | Oikawa et al. | 412/22 X |
| 5,295,775 | 3/1994 | Andjelic et al. | 412/22 |

*Primary Examiner*—Willmon Fridie, Jr.

*Attorney, Agent, or Firm*—Koda & Androlia

[57] ABSTRACT

A binding apparatus includes a cutting mechanism for cutting a primary continuous form vertically into two equal sheets of secondary continuous form, a primary pasting mechanism for pasting a side edge of one of the secondary continuous form sheets in the form of a line or band, a secondary continuous form superposing and feeding mechanism for superposing the other secondary continuous form sheet on the one secondary continuous form sheet so that cross perforation lines are overlapped with each other and feeding the superposed continuous form sheets, a secondary pasting mechanism for pasting a side edge of the other secondary continuous form sheet in the form of the line or band, a separating mechanism for separating the superposed secondary continuous form sheets along the cross perforation lines so that pieces of superposed sheets are obtained, a piling mechanism for piling two pieces of superposed sheets so that the piece of superposed sheet fed from the separating mechanism creeps under the previously fed piece of superposed sheet, the piling mechanism piling a predetermined number of sets of the pieces of superposed sheets, and a pressing mechanism for pressing the predetermined number of sets of the pieces of superposed sheets so that the pieces are pasted together to be bound into a booklet.

6 Claims, 9 Drawing Sheets

BINDING APPARATUS

BACKGROUND OF THE INVENTION

1. Field of the Invention

This invention relates to a binding apparatus, and more particularly to a binding apparatus suitable for binding, into a thin booklet, pieces of paper obtained by cutting into a predetermined size a continuous form printed out by a printer connected to a computer, for example, a combined notification for tax payment and official receipt issued by a municipality.

2. Description of the Prior Art

A combined notification for tax payment and official receipt issued by a municipality is made as follows. A continuous form printed out by a printer connected to a computer is cut into pieces of paper of a predetermined size. The continuous form has marginal slits formed in opposite edges thereof at regular intervals and cross perforation lines formed at regular intervals. A predetermined number of cut pieces of the continuous form are bound together into a booklet. Binding the backs of the cut pieces of the form with paste is difficult since the booklet is thin. Accordingly, metal wires or metal staples have conventionally been used to bind the cut pieces of the continuous form.

However, there is a possibility that a sharp end of the metal wire or metal staple may hurt the user. Furthermore, the wires or the staples need to be removed from the booklet when the booklet is cut by a paper-shredder. Removing the metal wires or staples from the booklet is troublesome.

SUMMARY OF THE INVENTION

Therefore, an object of the present invention is to provide a binding apparatus which can cut the continuous form printed out by the printer connected to the computer into pieces of a predetermined size and bind the cut pieces into a booklet using a paste but not using any metal wires or staples.

The present invention provides a binding apparatus wherein a primary continuous form with margin slits formed in opposite edges at regular intervals and cross perforation lines formed at regular intervals is cut into pieces of a predetermined size, and a predetermined number of pieces each having one side edge to which paste is applied in the form of a line or band are put one upon the other and pasted together into a booklet. The binding apparatus comprises a cutting mechanism for cutting the primary continuous form vertically into two equal sheets of secondary continuous form. A primary pasting mechanism is provided for pasting a side edge of one of the secondary continuous form sheets in the form of the line or band. A secondary continuous form superposing and feeding mechanism is provided for superposing the other secondary continuous form sheet on said one secondary continuous form sheet so that the cross perforation lines are overlapped with each other and feeding the superposed continuous form sheets. A secondary pasting mechanism is provided for pasting a side edge of said other secondary continuous form sheet in the form of the line or band. A separating mechanism is provided for separating the superposed secondary continuous form sheets along the cross perforation lines so that pieces of superposed sheets are obtained. A piling mechanism is provided for piling two pieces of superposed sheets so that the piece of superposed sheet fed from the separating mechanism creeps under the previously fed piece of superposed sheet, the piling mechanism piling a predetermined number of sets of the pieces of superposed sheets. A pressing mechanism is provided for pressing the predetermined number of sets of the pieces of superposed sheets so that the pieces are pasted together to be bound into a booklet.

According to the above-described construction, the primary continuous form is cut into pieces of paper of a predetermined size and a predetermined number of pieces of paper are stacked together and pasted into a booklet through the processes by the cutting mechanism, first pasting mechanism, secondary continuous form superposing and feeding mechanism, secondary pasting mechanism, piling mechanism and pressing mechanism. Since the steps necessary for binding a booklet are continuously arranged, the primary continuous form can be processed at high speeds into the booklet.

Furthermore, the side edge of each paper piece is pasted so that the paper sheets are bound together. Thus, a thin booklet can be bound without use of metal wires or metal staples. Accordingly, since there is no possibility that the metal wire or staple would hurt fingers of the user etc., the safety of the booklet can be improved. Additionally, since the metal wires or staples need not be removed from the booklet when the booklet is cut into pieces by a paper shredder, the booklet can readily be disposed.

Additionally, even when the booklet is automatically enclosed in an envelope etc. or sealed, the wire or the staple is not caught, the efficiency of the enclosing work and the sealing work can be improved.

In a preferred form, the cutting mechanism includes a pair of left-hand and right-hand pin tractors engaging the margin slits and a pair of upper and lower rotary blades, and the primary continuous form is fed by the pin tractors so as to be placed between the rotary blades so that the primary continuous form is cut by the blades into the two sheets.

In another preferred form, each of the primary and secondary pasting mechanisms includes a paste discharge nozzle, a sensor for detecting a marking formed together with each cross perforation line to thereby deliver an output signal, control means for controlling the paste discharge nozzle, and the control means controls timings for start and end of a discharging operation of the paste discharge nozzle on the basis of the output signal delivered by the sensor so that the paste in the form of the line or the band is prevented from crossing the cross perforation lines.

In further another preferred form, the secondary continuous form superposing and feeding mechanism includes a pair of left-hand and right-hand pin tractors engaged with the margin slits of the secondary continuous form sheets so that the secondary continuous form sheets are superposed so that the cross perforation lines of the secondary continuous form sheets overlap each other and fed.

In further another preferred form, the separating mechanism includes a pair of front upper and lower feed rollers and a pair of rear upper and lower feed rollers holding the superposed secondary continuous form sheets therebetween and feeding the secondary continuous form sheets, and a blade provided between the front and rear feed rollers and abutting the secondary continuous form sheets in parallel with the cross perforation lines of the form sheets held between the front and rear rollers, and a feeding speed at which the second continuous form sheet is fed by the front rollers is set to be higher than a feeding speed at which the second continuous form sheet is fed by the rear rollers, so that the superposed secondary continuous form sheets are separated along the cross perforation lines.

In further another preferred form, the piling mechanism includes an endless belt extending between a pair of rollers and a stopper protruding upwardly so as to be retractable from the endless belt, and the separating mechanism feeds the superposed paper pieces onto the endless belt running and the stopper stops the superposed paper pieces, the stopper being retracted from over the endless belt when a predetermined number of sets of superposed paper pieces are fed.

BRIEF DESCRIPTION OF THE DRAWINGS

Other objects, features and advantages of the present invention will become clear upon reviewing the following description of the preferred embodiment, made with reference to the accompanying drawings, in which.

DETAILED DESCRIPTION OF THE PREFERRED EMBODIMENT

Figure 1:
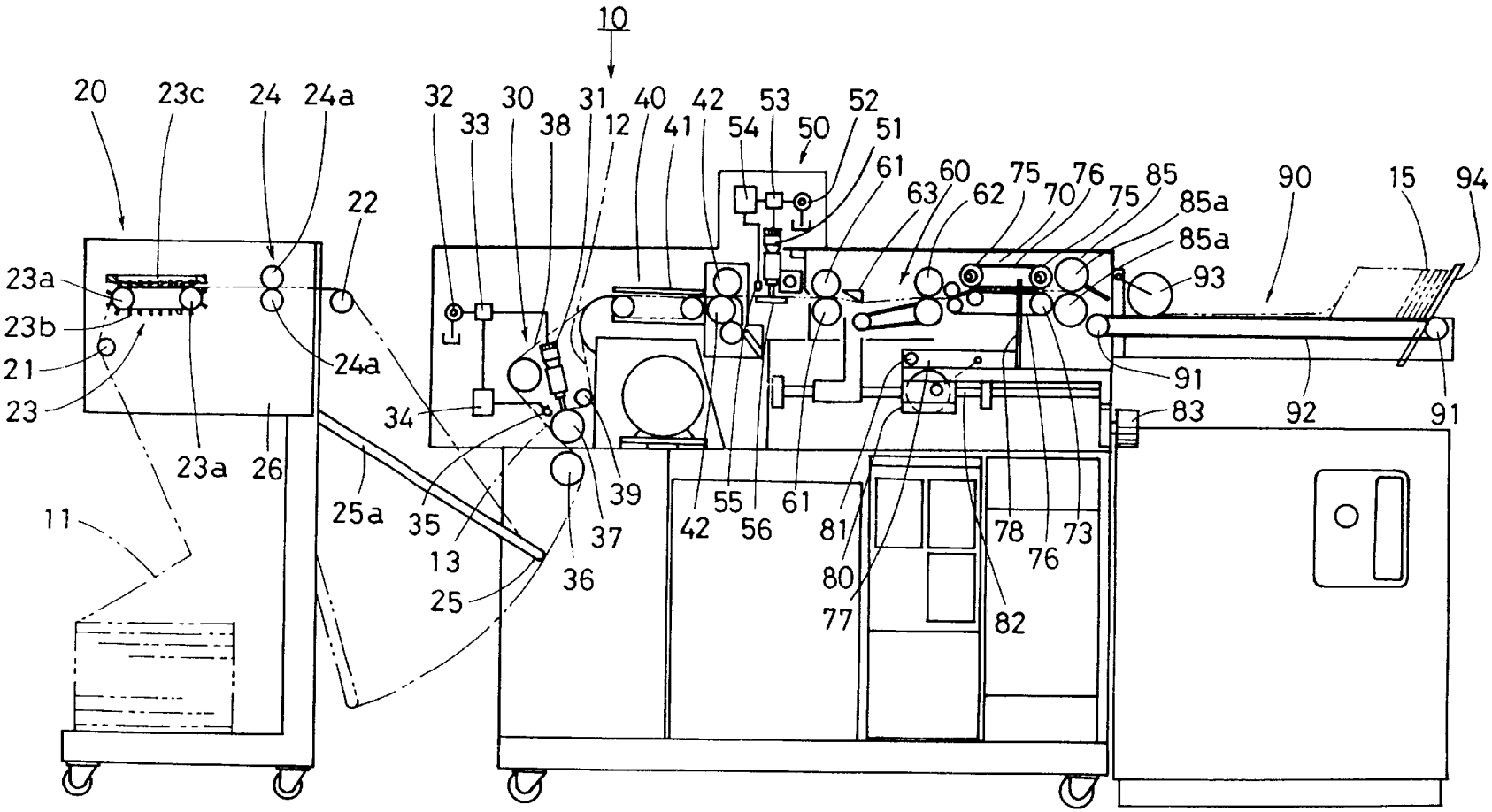
FIG. 1 illustrates a schematic construction of the binding apparatus embodying the present invention.
Figure 2:
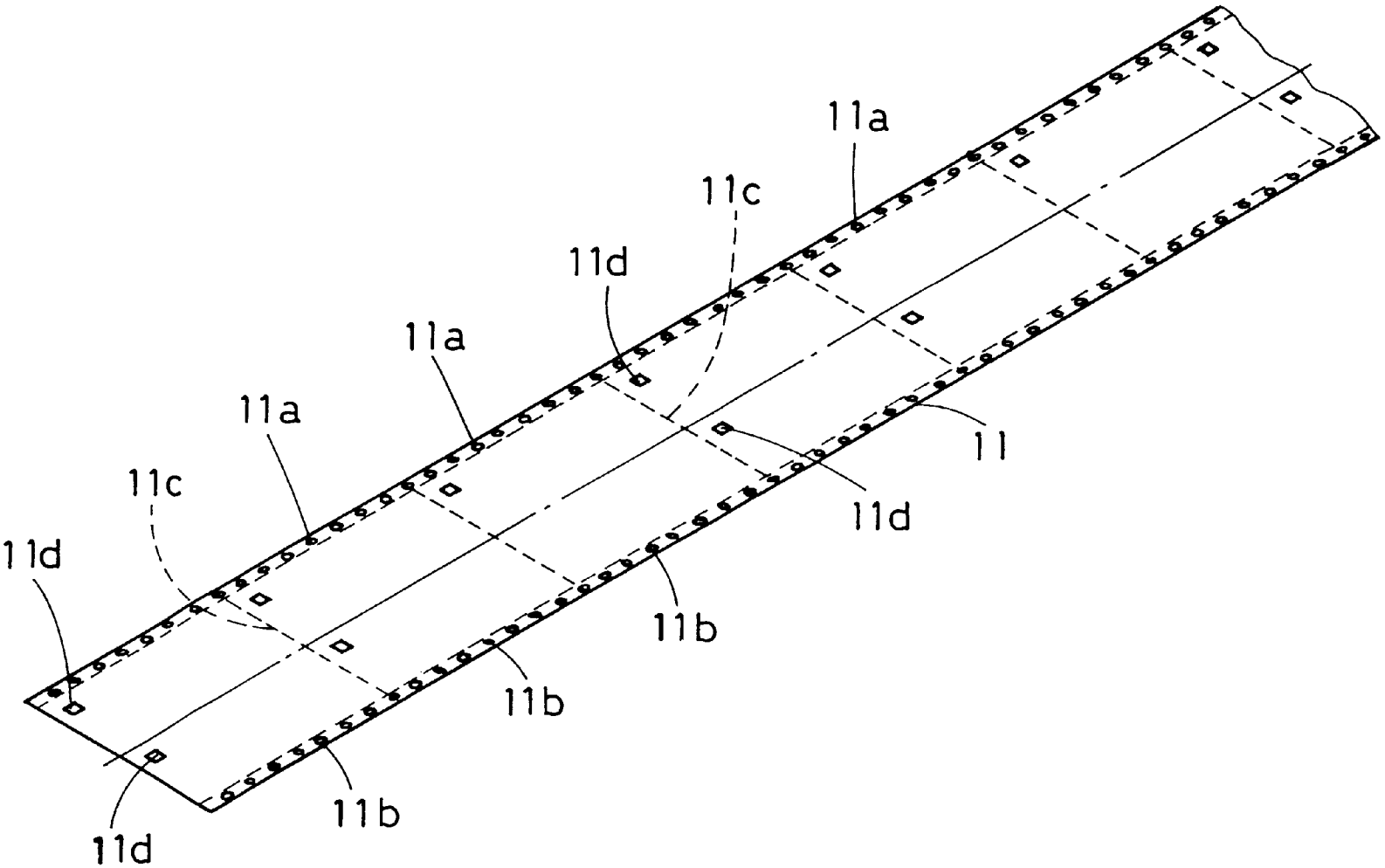
FIG. 2 is a perspective view of a primary continuous form used in the binding mechanism.

One embodiment of the present invention will be described with reference to the accompanying drawings. Referring to FIG. 1, a book binding mechanism 10 in accordance with the invention is schematically shown. FIG. 2 shows a primary continuous form supplied to the binding mechanism 10. The binding mechanism 10 includes a cutting mechanism 20, a primary pasting mechanism 30, a superposing and feeding mechanism 40, a secondary pasting mechanism 50, a separating mechanism 60, a piling mechanism 70, a pressing mechanism 85 and a stacking mechanism 95.

The cutting mechanism 20 comprises guide rollers 21 and 22, a pair of left-hand and right-hand pin tractors 23, a slitter 24, and a tension bar 25. Each pair of pin tractor 23 includes a pair of front and rear rollers 23*a* and an endless belt 23*b* extending between the rollers 23*a*, and a presser plate 23*c*. The presser plate has an elongate hole into which the pin is inserted.

The slitter 24 includes a pair of upper and lower rotary blades 24*a*. The tension bar 25 is provided integrally on a distal end of an arm 25*a* rotatably mounted on a frame 26 of the cutting mechanism 20.

Referring to FIG. 2, a primary continuous form 11 is formed with marginal slits 11*a* and 11*b*, cross perforation lines 11*c* and markings 11*d*. The marginal slits 11*a* and 11*b* are formed in both side edges at regular intervals respectively. The intervals of the marginal slits 11*a* and 11*b* are the same as those of the pins of each pin tractor 23. The cross perforation lines 11*c* are formed at predetermined regular intervals. The markings 11*d* are provided so as to correspond to the respective cross perforation lines 11*c*. Two markings 11*d* are formed for some of the cross perforation lines 11*c*, whereas one marking 11*d* is formed for some of the cross perforation lines 11*c*. As obvious from FIG. 2, the markings 11*d* formed on one side edge of the primary continuous form 11 are continuous, whereas the markings 11*d* formed on the other side edge of the primary continuous form 11 are intermittent.

Figure 3:
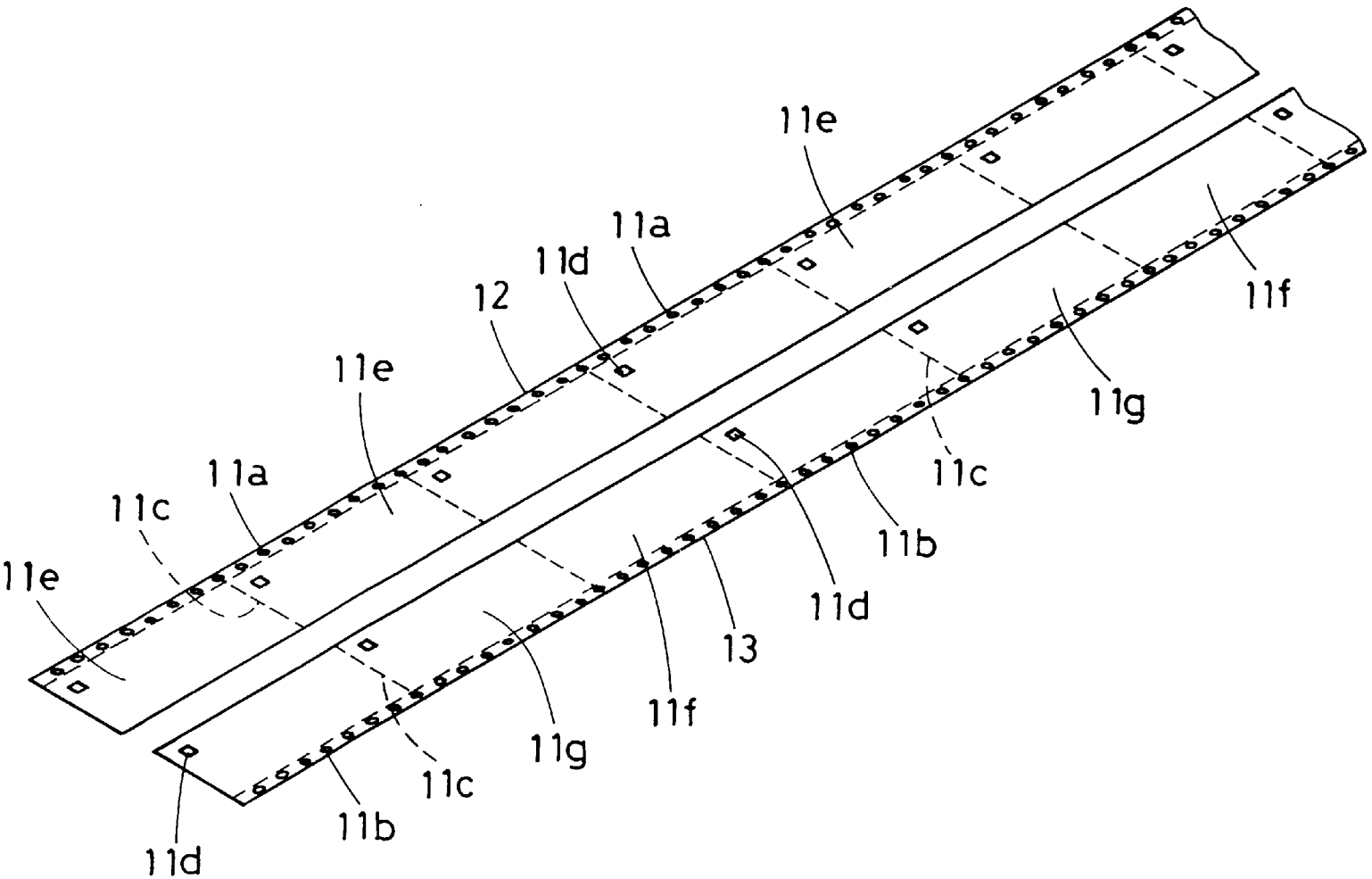
FIG. 3 is a perspective view of two sheets of a secondary continuous form formed by cutting the primary continuous form.

The pin tractors 23 are loaded with the primary continuous form 11 so that the marginal perforations 11*a* and 11*b* are engaged with the pins thereof. The pin tractors 23 feed the primary continuous form 11 to the slitter 24, which cut the form 11 along the center line such that two sheets of secondary continuous form 12 and 13 are formed as shown in FIG. 3. The secondary continuous form sheets 12 and 13 cut in the cutting mechanism 20 are laid one upon the other or between the guide roller 22 and the tension bar 25 and then fed to the primary pasting mechanism 30. The tension bar 25 is rotated so that a tension applied to the two secondary continuous form sheets is maintained at a predetermined value.

The primary pasting mechanism 30 comprises a paste discharge nozzle 31, a pump 32, an electromagnetic valve 33, an electromagnetic valve control circuit 34, a sensor 35, guide rollers 36, 37, 38 and 39. Of the two superposed secondary continuous form sheets 12 and 13, the upper sheet 13 is fed between the guide rollers 36 and 37 and through the guide roller 38 to the secondary continuous form sheet lap feeding mechanism 40. The lower sheet 12 is fed between the guide rollers 36 and 37 through the guide roller 39 to the secondary continuous form sheet lapping and feeding mechanism 40. The sensors 35 and the paste discharge nozzle 31 are disposed in proximity to the guide roller 37. The sensor 35 detects the marking 11*d* to thereby deliver an output signal when the lower secondary continuous form sheet 12 passes the guide roller 37. The control circuit 34 controls the electromagnetic valve 33 so that the valve is opened and closed in synchronization with the output signal from the sensor 35, whereby the paste is discharged from the nozzle 31 so that paste 14 is applied to the surface side edge of the lower secondary continuous form 12 in the form of a predetermined length of line or band so as not cross the perforation lines 11*c*.

The secondary continuous form superposing and feeding mechanism 40 includes a pair of left-hand and right-hand pin tractors 41. Each pin tractor 41 has the same construction as each pin tractor 23 of the cutting mechanism 20. The superposing and feeding mechanism 40 superposes the upper secondary continuous form 13 having passed the guide roller 38 of the primary pasting mechanism 30 and the lower secondary continuous form 12 having passed the guide roller 39 so that the cross perforation lines 11*c* of the forms 12 and 13 overlap each other. The marginal slits 11*a* and 11*b* are engaged with the pins of the pin tractor 41.

Figure 5:
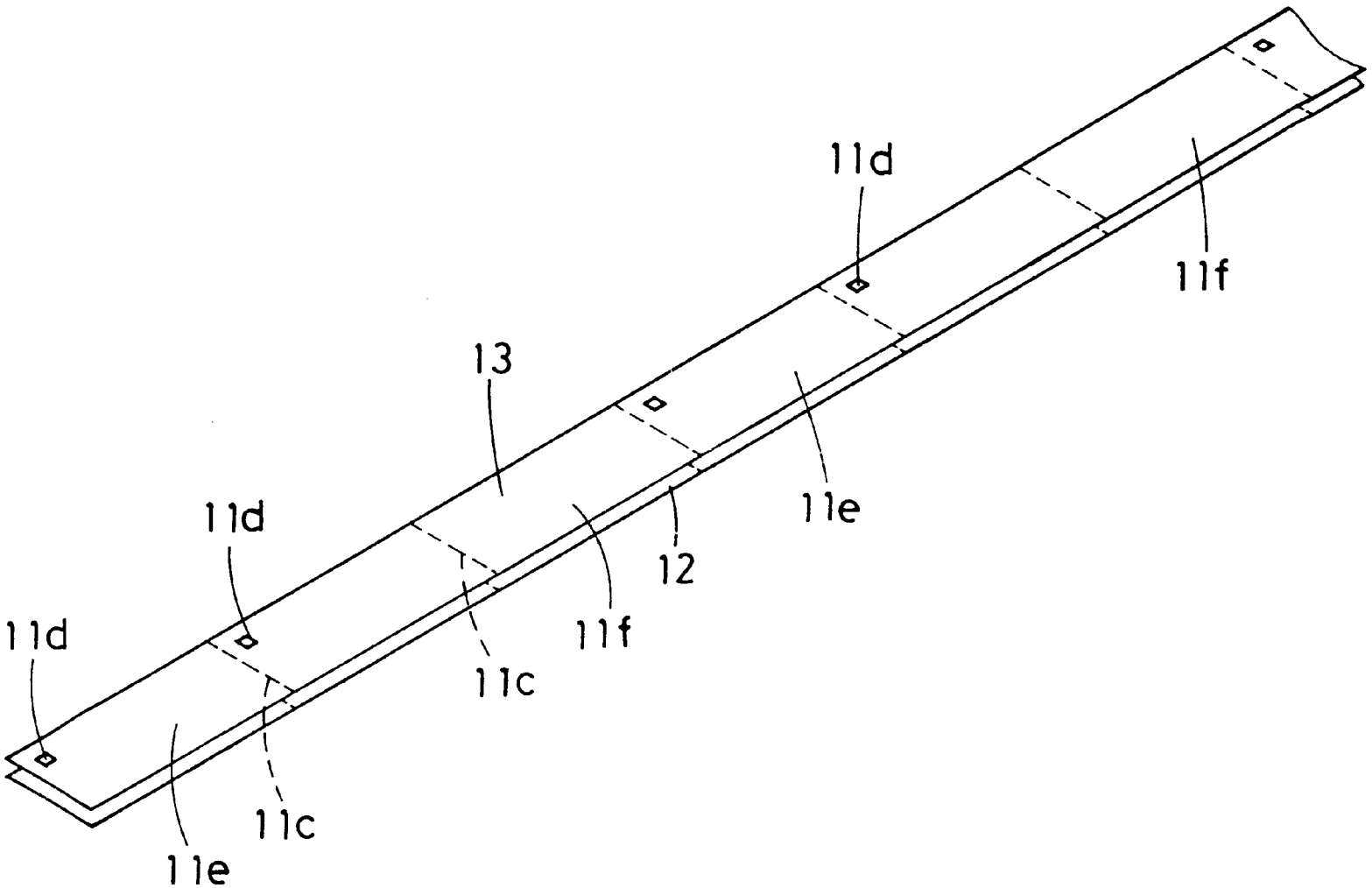
FIG. 5 is a perspective view of the one secondary continuous form sheet and the other secondary continuous form sheet superposed thereon.

A pair of upper and lower rotary blades 42 are provided on the rear ends of the pin tractors 41 to remove the side edges of the secondary continuous form sheets 12 and 13, in which side edges the marginal slits 11*a* and 11*b* are formed. The side edges of the two sheets of secondary continuous form 12 and 13 fed from the pin tractors 41 are cut and removed when passing between the rotary blades 42 and 43 as shown in FIG. 5. The secondary continuous form sheets 12 and 13 from which the side edges have been removed are fed by the mechanism 40 to the secondary pasting mechanism 50.

The secondary pasting mechanism 50 comprises a paste discharge nozzle 51, a pump 52, an electromagnetic valve 53, an electromagnetic valve control circuit 54, a sensor 55 and a guide plate 56. The sensor 55 detects the marking of the upper secondary continuous form sheet 13 to thereby deliver an output signal when the two superposed secondary continuous form sheets 12 and 13 pass over the guide plate 56. The control circuit 54 controls the electromagnetic valve 53 so that the valve is opened and closed in synchronization with the output signal from the sensor 55, whereby the paste is discharged from the nozzle 31 so that paste 14 is applied to the surface side edge of the upper secondary continuous form 13 in the form of a predetermined length of line or band so as not cross the perforation lines 11*c*.

Figure 4:
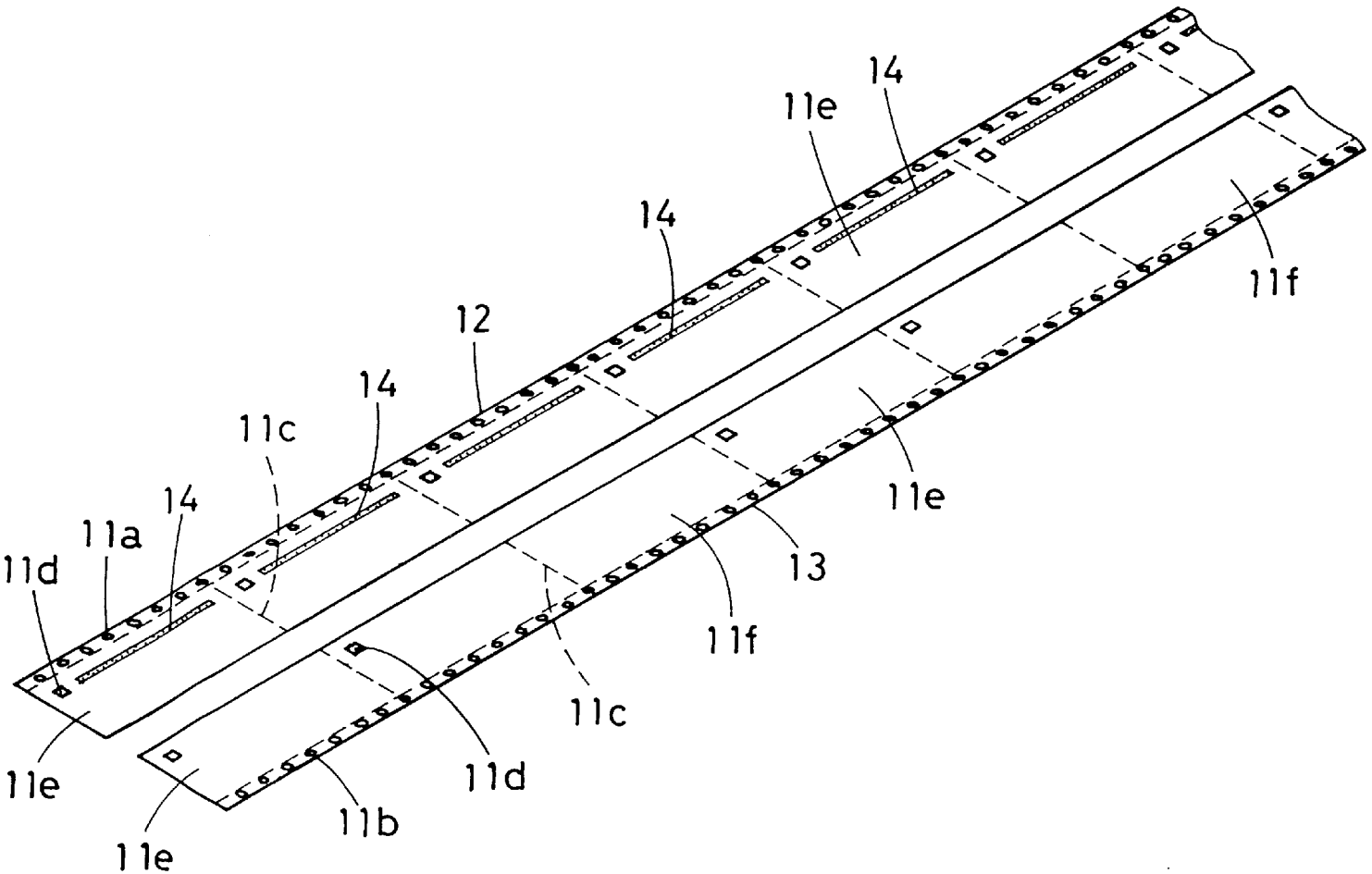
FIG. 4 is a perspective view of one secondary continuous form sheet which is pasted in the form of a line or band and the other secondary continuous form sheet which is not pasted.
Figure 6:
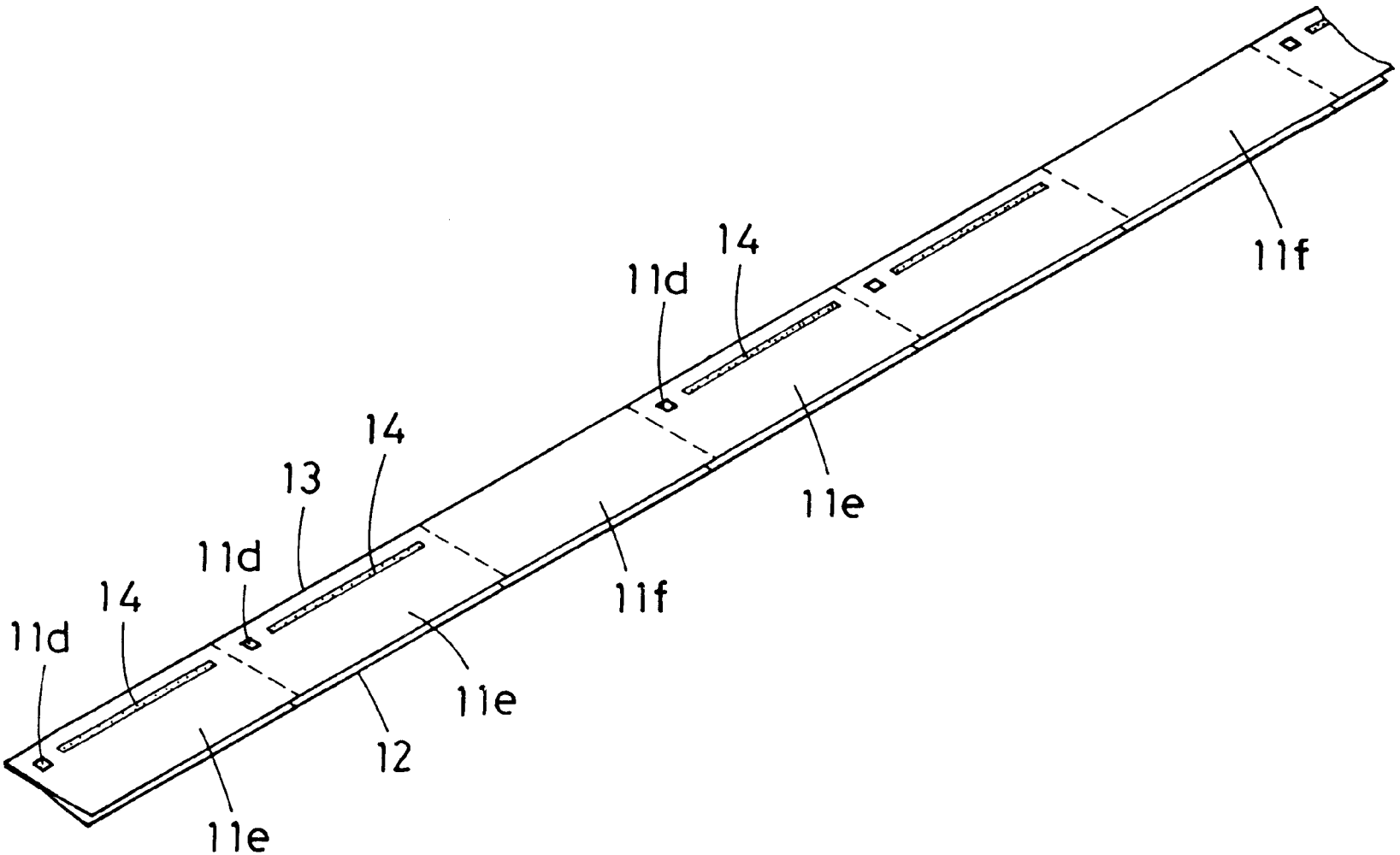
FIG. 6 is a perspective view of the one secondary continuous form sheet and the other secondary continuous form sheet superposed thereon and pasted.

Referring to FIGS. 3 to 5, the markings 11*d* are placed so as to correspond to all the cross perforation lines 11*c* of the secondary continuous form sheet 12, so that a row of the markings 11*d* is formed lengthwise. On the other hand, the markings 11*d* are eliminated every three cross perforation line 11*c*. Accordingly, as shown in FIG. 6, the paste 14 is applied to the pieces 11*e* of the upper secondary form sheet 13 carrying the respective markings 11*d*, whereas the paste 14 is not applied to the pieces 11*f* not carrying the markings 11*d*.

Figure 7:
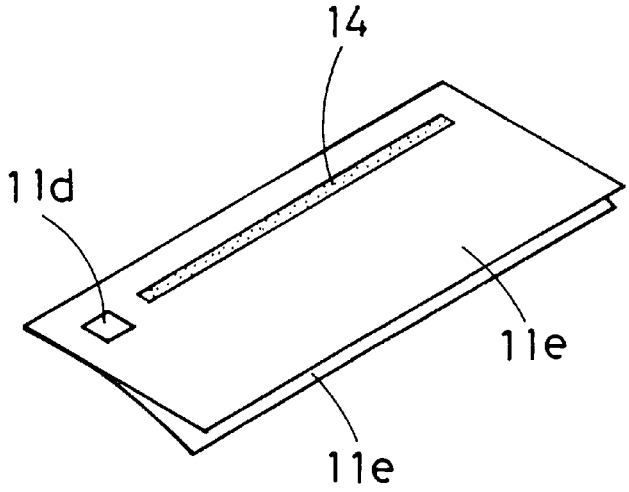
FIG. 7 is a perspective view of the superposed paper piece.
Figure 9:
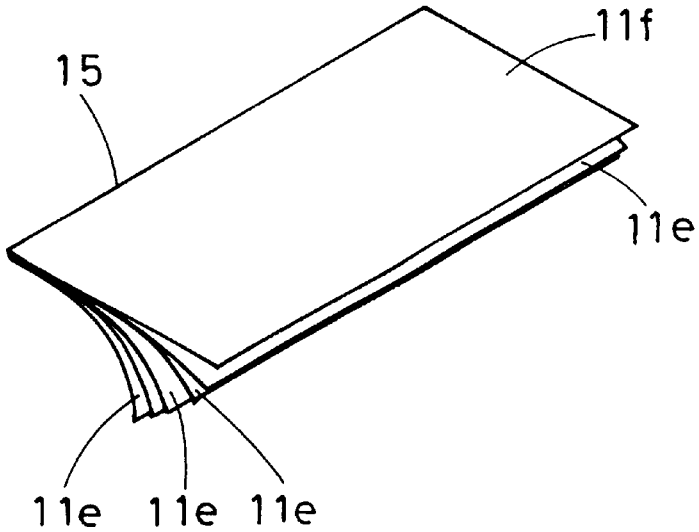
FIG. 9 is a perspective view of a booklet.

The separating mechanism 60 comprises a pair of upper and lower front feed rollers 61, a pair of upper and lower rear feed rollers 62, and a blade 63 disposed so as to come into contact with the secondary continuous form sheets 12 and 13 in parallel with the cross perforation lines 11*c* between the front and rear rollers 61 and 62. A speed at which the front rollers 61 feed the secondary continuous form sheets 12 and 13 is set to be higher than a speed at which the rear rollers 62 feed the secondary continuous form sheets 12 and 13. Accordingly, when passing the blade 63, the two superposed secondary continuous form sheets 12 and 13 are torn off along the cross perforation lines 11*c* to thereby be separated into pieces of superposed paper 11*e* as shown in FIG. 7.

Figure 8:
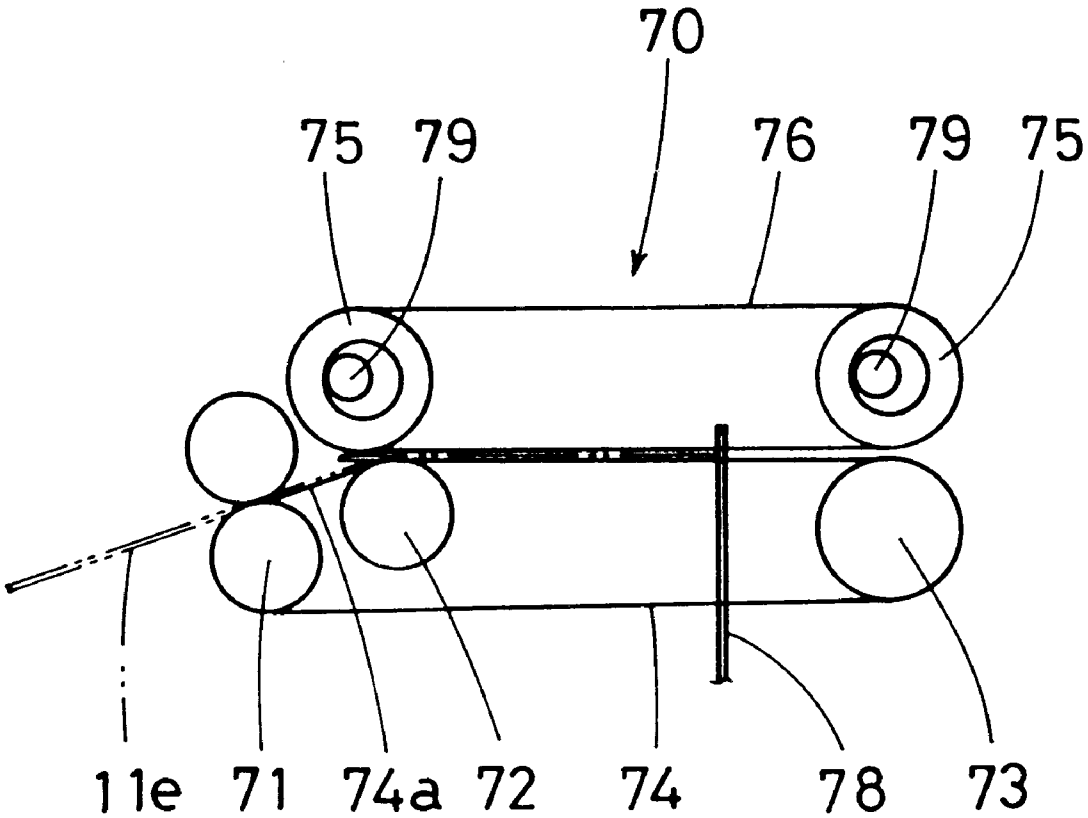
FIG. 8 schematically illustrates the separating mechanism.
Figure 10:
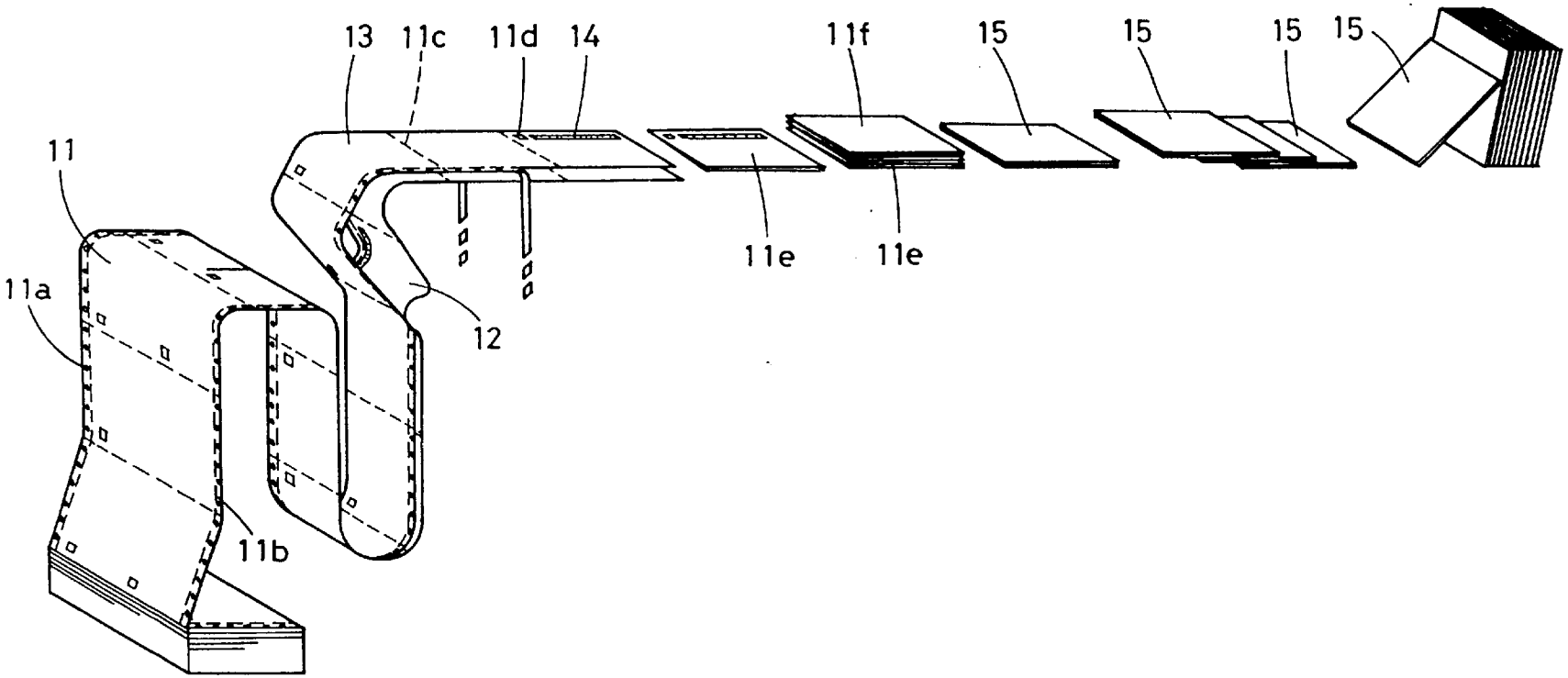
FIG. 10 schematically illustrates steps of binding the booklet sequentially from the primary continuous form.

Referring to FIG. 8, the piling mechanism 70 comprises rollers 71, 72 and 73, a lower endless belt 74 spanning these rollers 71 to 73, a pair of front and rear rollers 75, an upper endless belt 76 spanning the rollers 75, and a stopper 78 standing from a distal end of a lever 77. The rollers 75 are supported on an eccentric shafts 29 respectively. The eccentric shafts 79 are rotated so that the rollers 75 are moved upward and downward, whereupon a space between the upper and lower endless belts 76 and 74 are adjusted. A forward half 74*a* of the belt 74 forms a rearwardly rising slope. The stopper 78 is provided so as to protrude upward from the side edge of the lower belt 74. The lever 77 carrying the stopper 78 is mounted on a bracket 80 to be vertically rotatable about a shaft 81. The stopper 78 retracts from over the belt 74 when the lever 77 is downwardly rotated. The bracket 80 is mounted on a screw shaft 82 so as to be moved forward and backward. When a knob 83 is rotated, the screw shaft 82 is rotated so that the bracket 80 and accordingly the stopper 78 are moved forward and backward.

The pieces of superposed paper 11*e* obtained by separating the superposed secondary continuous form sheets 12 and 13 by the separating mechanism 60 are sequentially fed to the forward half 74*a* of the running lower belt 74, passing the roller 72. When abutting the stopper 78, the superposed paper pieces 11*e* are stopped on the running belt 74, being held between the upper and lower belts 76 and 74.

The superposed paper piece 11*e* including the non-pasted upper paper piece is previously fed into the belt 74 onto which no superposed paper piece 11*e* has been fed. The pasted superposed paper piece 11*e* is then fed onto the belt 74. The stopper 78 is positioned so that when the superposed paper piece 11*e* abuts the stopper on the belt 74 to be stopped, the front end of the superposed paper piece protrudes toward the forward half or slope 74*a*. Consequently, the succeeding superposed paper piece 11*e* creeps under the previous superposed paper piece 11*e* such that the superposed paper pieces 11*e* are piled up together. The piled paper pieces 11*e* are held between the upper and lower belts 76 and 74. Thus, since the succeeding superposed paper piece 11*e* creeps under the previous superposed paper piece 11*e* so that these superposed paper pieces 11*e* are piled together, the paste 14 applied to the surface of the previous superposed paper piece 11*e* is prevented from being torn off by the distal end of the succeeding superposed paper piece 11*e*.

The number of sets of the superposed paper pieces 11e stacked on the belt 74 is counted on the basis of the signals delivered from the sensors 35 and 55. When the number reaches three, an actuator (not shown) is operated to downwardly rotate the lever 77. As a result, three sets of superposed paper pieces 11*e* stacked on the belt 74 are fed to the pressing mechanism 85. A feeding speed of the belt 74 is set to be higher than that of the separating mechanism 60. Accordingly, the piled three sets of the superposed paper pieces 11*e* is fed to the pressing mechanism 85 before the next non-pasted superposed paper piece 11*e* abuts the stopper 78.

The pressing mechanism 85 comprises a pair of upper and lower rotary press rollers 85*a*. When the three sets of the superposed paper pieces 11*e* pass between the press rollers 85*a*, the pasted side edges thereof are pressed by the press rollers so that the paper pieces 11*e* are completely bonded together. Consequently, the three sets of the superposed paper pieces 11*e* are bound into a six-piece booklet 15, which is then fed to the stacking mechanism 90.

The stacking mechanism 90 comprises a pair of forward and rear rotating rollers 91, an endless belt 92 having a large coefficient of friction and extending between the rollers 91, a guide roller 93 disposed near the forward rotating roller 91, and a stopper plate 94 standing obliquely near the rear rotating roller 91. The booklet 15 is fed from the pressing mechanism 85 to the front end of the belt 92. The guide roller 93 presses the booklet 15 against the belt 92. The belt 92 feeds the booklet 15 rearward so that the booklet abuts the stopper plate 94. When abutting the stopper plate 94, the booklet 15 stands along the stopper plate 94, thereby being stacked in the standing state.

When the primary continuous form 11 is supplied to the binding apparatus 10 of the embodiment, the form 11 is cut into the two sheets of the secondary continuous form 12 and 13. The lower secondary continuous form 11 is pasted. The marginal slits 11*a* and 11*b* of the superposed secondary continuous form sheets 12 and 13 are cut and removed. The upper secondary continuous form sheet 13 is pasted. The superposed two secondary continuous form sheets 12 and 13 are separated along the perforation lines into the superposed paper pieces 11*e*. A predetermined number of sets of paper pieces lie are stacked together. The pasted portions of the stacked paper pieces 11*e* are pressed to be bound into the book let 15. These binding steps are sequentially carried out.

According to the above-described embodiment, the paper pieces 11*e* and 11*f* can be bound with the paste 14 without use of the metal wire nor staple even when the booklet 15 is thin. Accordingly, since there is no possibility that the metal wire or staple would hurt the user, the safety of the booklet can be improved. Furthermore, since the metal wires or staples need not be removed from the booklet when the booklet is cut into pieces by a paper shredder, the booklet can readily be disposed of. Additionally, even when the booklet 15 is automatically enclosed in an envelope etc. or sealed, the wire or the staple is not caught, the efficiency of the enclosing work and the sealing work can be improved.

The foregoing description and drawings are merely illustrative of the principles of the present invention and are not to be construed in a limiting sense. Various changes and modifications will become apparent to those of ordinary skill in the art. All such changes and modification are seen to fall within the scope of the present invention as defined by the appended claims.

I claim:

1. A binding apparatus wherein a primary continuous form with margin slits formed in opposite edges at regular intervals and cross perforation lines formed at regular intervals is cut into pieces of a predetermined size, and a predetermined number of pieces each having one side edge to which paste is applied in the form of a line or band are put one upon the other and pasted together into a booklet, the apparatus comprising:

a cutting mechanism for cutting the primary continuous form vertically into two equal sheets of secondary continuous form;

a primary pasting mechanism for pasting a side edge of one of the secondary continuous form sheets in the form of the line or band;

a secondary continuous form superposing and feeding mechanism for superposing the other secondary continuous form sheet on said one secondary continuous form sheet so that the cross perforation lines are overlapped with each other and feeding the superposed continuous form sheets;

a secondary pasting mechanism for pasting a side edge of said other secondary continuous form sheet in the form of the line or band;

a separating mechanism for separating the superposed secondary continuous form sheets along the cross perforation lines so that pieces of superposed sheets are obtained;

a piling mechanism for piling two pieces of superposed sheets so that the piece of superposed sheet fed from the separating mechanism creeps under the previously fed piece of superposed sheet, the piling mechanism piling a predetermined number of sets of the pieces of superposed sheets; and a pressing mechanism for pressing the predetermined number of sets of the pieces of superposed sheets so that the pieces are pasted together to be bound into a booklet.

2. A binding apparatus according to claim 1, wherein the cutting mechanism includes a pair of left-hand and right-hand pin tractors engaging the margin slits and a pair of upper and lower rotary blades, and wherein the primary continuous form is fed by the pin tractors so as to be placed between the rotary blades so that the primary continuous form is cut by the blades into the two sheets.

3. A binding apparatus according to claim 1, wherein each of the primary and secondary pasting mechanisms includes a paste discharge nozzle, a sensor for detecting a marking formed together with each cross perforation line to thereby deliver an output signal, control means for controlling the paste discharge nozzle, and wherein the control means controls timings for start and end of a discharging operation of the paste discharge nozzle on the basis of the output signal delivered by the sensor so that the paste in the form of the line or the band is prevented from crossing the cross perforation lines.

4. A binding apparatus according to claim 1, wherein the secondary continuous form superposing and feeding mechanism includes a pair of left-hand and right-hand pin tractors engaged with the margin slits of the secondary continuous form sheets so that the secondary continuous form sheets are superposed so that the cross perforation lines of the secondary continuous form sheets overlap each other and fed.

5. A binding apparatus according to claim 1, wherein the separating mechanism includes a pair of front upper and lower feed rollers and a pair of rear upper and lower feed rollers holding the superposed secondary continuous form sheets therebetween and feeding the secondary continuous form sheets, and a blade provided between the front and rear feed rollers and abutting the secondary continuous form sheets in parallel with the cross perforation lines of the form sheets held between the front and rear rollers, and a feeding speed at which the second continuous form sheet is fed by the front rollers is set to be higher than a feeding speed at which the second continuous form sheet is fed by the rear rollers, so that the superposed secondary continuous form sheets are separated along the cross perforation lines.

6. A binding apparatus according to claim 1, wherein the piling mechanism includes an endless belt extending between a pair of rollers and a stopper protruding upwardly so as to be retractable from the endless belt, and the separating mechanism feeds the superposed paper pieces onto the endless belt running and the stopper stops the superposed paper pieces, the stopper being retracted from over the endless belt when a predetermined number of sets of superposed paper pieces are fed.

* * * * *